US011549352B2

(12) United States Patent
Johnsen et al.

(10) Patent No.: US 11,549,352 B2
(45) Date of Patent: Jan. 10, 2023

(54) SYSTEM AND METHOD FOR OFFSHORE HYDROCARBON PRODUCTION AND STORAGE

(71) Applicant: Equinor Energy AS, Stavanger (NO)

(72) Inventors: Cecilie Gotaas Johnsen, Trondheim (NO); Arild Samuelsberg, Haugesund (NO)

(73) Assignee: Equinor Energy AS, Stavanger (NO)

( * ) Notice: Subject to any disclaimer, the term of this patent is extended or adjusted under 35 U.S.C. 154(b) by 16 days.

(21) Appl. No.: 17/050,170

(22) PCT Filed: Apr. 24, 2019

(86) PCT No.: PCT/NO2019/050093
§ 371 (c)(1),
(2) Date: Oct. 23, 2020

(87) PCT Pub. No.: WO2019/209119
PCT Pub. Date: Oct. 31, 2019

(65) Prior Publication Data

US 2021/0079764 A1 Mar. 18, 2021

(30) Foreign Application Priority Data

Apr. 24, 2018 (NO) ..... 20180573

(51) Int. Cl.
*E21B 43/36* (2006.01)
*E21B 43/017* (2006.01)
(Continued)

(52) U.S. Cl.
CPC ..... *E21B 43/36* (2013.01); *E21B 43/013* (2013.01); *E21B 43/017* (2013.01); *E21B 43/40* (2013.01)

(58) Field of Classification Search
CPC ..... E21B 43/36; E21B 43/013; E21B 43/017; E21B 43/40
See application file for complete search history.

(56) References Cited

U.S. PATENT DOCUMENTS 3,504,741 A 4/1970 Baker et al.
3,880,102 A 4/1975 Biewer
(Continued)

FOREIGN PATENT DOCUMENTS

CN 102337868 A 2/2012
CN 106593363 A 4/2017
(Continued)

OTHER PUBLICATIONS

Jul. 3, 2019—(WO) International Search Report and Written Opinion—App PCT/NO2019/050092.
(Continued)

*Primary Examiner* — Aaron L Lembo
(74) *Attorney, Agent, or Firm* — Banner & Witcoff, Ltd.

(57) ABSTRACT

A system for hydrocarbon production comprising a host for receiving produced hydrocarbon; an offshore hydrocarbon production facility comprising: a production wellhead for connection to a subsea hydrocarbon reservoir; a production platform configured to receive produced fluid from the wellhead and being in fluid communication with the host via a long distance pipeline wherein the wellhead is local to the production platform, and the production platform is configured to process the produced fluid to provide a semi-stable oil product suitable for exporting along the long distance pipeline to the host; wherein the host is configured to store the semi-stable oil product.

21 Claims, 4 Drawing Sheets

(51) Int. Cl.
*E21B 43/40* (2006.01)
*E21B 43/013* (2006.01)

(56) References Cited

U.S. PATENT DOCUMENTS

| | | | | | |
|---|---|---|---|---|---|
| 4,127,003 | A | | 11/1978 | Vilain | |
| 4,968,332 | A | * | 11/1990 | Maher | B01D 19/0042 55/385.4 |
| 5,390,743 | A | | 2/1995 | Giannesini | |
| 5,477,924 | A | | 12/1995 | Pollack | |
| 5,988,283 | A | | 11/1999 | Gann | |
| 6,263,971 | B1 | | 7/2001 | Giannesini | |
| 6,672,391 | B2 | | 1/2004 | Anderson et al. | |
| 8,273,151 | B2 | * | 9/2012 | Miotto | E21B 43/36 95/24 |
| 2003/0159581 | A1 | | 8/2003 | Sanderford et al. | |
| 2003/0188873 | A1 | | 10/2003 | Anderson et al. | |
| 2005/0072574 | A1 | | 4/2005 | Appleford et al. | |
| 2006/0004593 | A1 | | 1/2006 | Seat et al. | |
| 2010/0048963 | A1 | | 2/2010 | Jones et al. | |
| 2013/0008663 | A1 | | 1/2013 | Maclean et al. | |
| 2014/0345299 | A1 | * | 11/2014 | Kirk | F17C 13/082 62/53.2 |
| 2015/0300146 | A1 | * | 10/2015 | Grave | E21B 43/36 166/368 |
| 2018/0030823 | A1 | | 2/2018 | Nedwed et al. | |
| 2018/0266229 | A1 | | 9/2018 | Fredheim et al. | |
| 2018/0345176 | A1 | * | 12/2018 | Roberts | C02F 1/40 |

FOREIGN PATENT DOCUMENTS

| | | | | | |
|---|---|---|---|---|---|
| GB | 1244273 | A | | 8/1971 | |
| GB | 2133446 | A | | 7/1984 | |
| GB | 2255102 | A | * | 10/1992 | E21B 43/01 |
| GB | 2255102 | A | | 10/1992 | |
| GB | 2544715 | A | * | 5/2017 | B63B 25/14 |
| GB | 2544715 | A | | 5/2017 | |
| GB | 2554076 | A | | 3/2018 | |
| KR | 101507226 | B1 | | 3/2015 | |
| KR | 20150111495 | A | | 10/2015 | |
| KR | 20150111497 | A | | 10/2015 | |
| WO | 9712118 | A1 | | 4/1997 | |
| WO | WO-0183947 | A1 | * | 11/2001 | E21B 43/36 |
| WO | 02063135 | A1 | | 8/2002 | |
| WO | 03086976 | A2 | | 10/2003 | |
| WO | WO-03086976 | A2 | * | 10/2003 | E21B 43/017 |
| WO | 17048132 | A1 | | 3/2017 | |
| WO | 2018139939 | A1 | | 8/2018 | |

OTHER PUBLICATIONS

Eurasian Office Action 565902EA of Eurasia National Phase application of PCT Application PCT/N02019/050093, earliest priority filing date Apr. 24, 2018.
Jul. 4, 2019—(WO) International Search Report and Written Opinion—Appl. No. PCT/NO2019/050093, 10 pages.
Nov. 15, 2018—(NO) Search Report—Appl. No. 20180573, 2 pages.
Nov. 15, 2018—(NO) Office Action—Appl. No. 20180573, 5 pages.
Zakarian, et al, "Shtokman: the management of flow assurance constraints in remote arctic environment", 24th World Gas Conference, (Oct. 5-9, 2009) Buenos Aires, Argentina.
Jahn, et al., 2008, Developments in Petroleum Science, pp. 297-302.
Argento et al., "Remote Deepwater Oil Field Tie-Back: Conventional or Innovative Solution?", Offshore Technology Conference, Paper OTC-22680-MS, Oct. 4-6, 2011, Rio de Janeiro, Brazil.
Yamamoto et al., "Integrated subsea production system: An overview on energy distribution and remote control", Petroleum and Chemical Industry Conference—Brasil (PCIC Brasil), Aug. 25-27, 2014, Rio de Janeiro, Brazil, pp. 173-181.
Mar. 12, 2018—Subject Matter Search Report, 10 pages.
Mar. 9, 2022 (EA) Office Action Application No. 202092534.
Jan. 10, 2022 (GB) Office Action Applicaiton No. GB2018439.6.
Feb. 15, 2022 (GB) Office Action Application GB2018425.5.
Feb. 14, 2022 (NO) Office Action Application No. 20180573.
Mar. 28, 2022 (EA) Translation of Office Action Application No. 202092527.

* cited by examiner

SYSTEM AND METHOD FOR OFFSHORE HYDROCARBON PRODUCTION AND STORAGE

The present application is a U.S. National Phase of International Application No. PCT/NO2019/050093, filed on Apr. 24, 2019, designating the United States of America and claiming priority to Norwegian Patent Application No. 20180573, filed on Apr. 24, 2018. This application claims priority to and the benefit of the above-identified applications, which are fully incorporated by reference herein in their entirety.

The present invention concerns a system for hydrocarbon production which is useful in (but not limited to) the exploitation of marginal sub-sea oil reserves, particularly those distributed over large areas of the seabed where it is not viable to implement dedicated manned platforms for each reserve.

Overcoming current economic difficulties in exploiting marginal oil reservoirs is becoming increasingly important as known large reserves are depleted and it becomes more desirable to exploit smaller reserves that are often distributed over wide areas within a given oilfield. In order to make the exploitation of such marginal reservoirs more economically sustainable, it is desirable to exploit as great an area of marginal oil reservoirs as possible with minimum equipment/personnel, outlay and running cost.

One known approach is to connect ("tie-back") a number of remote ("satellite") wells to a single platform in order to exploit multiple reservoirs that are some distance away. However, the fluid produced from a hydrocarbon well is typically a mixture including oil, water and gas. Such a mixture of fluid cannot be easily transported by pipeline, at least over long distances, because the multiple phases make it difficult to pump and because hydrates can form and block the pipeline.

Hydrates are ice-like crystalline solids composed of water and gas, and hydrate deposition on the inside wall of gas and/or oil pipelines is a severe problem in oil and gas production infrastructure. As discussed below with reference to FIG. 5, for a given hydrocarbon fluid, hydrates form at higher pressures and lower temperatures. When warm hydrocarbon fluid containing water flows through a pipeline with cold walls, hydrates will precipitate and adhere to the inner walls. This reduces the pipeline cross-sectional area, which, without proper counter measures, will lead to a loss of pressure and ultimately to a complete blockage of the pipeline or other process equipment. Transportation of gas over distance therefore normally requires hydrate control.

Existing technologies that deal with the problem of hydrate formation over short distances include:

- Mechanical scraping of the deposits from the inner pipe wall at regular intervals by pigging.
- Electric heating and insulation keeping the pipeline warm (above the hydrate formation temperature).
- Addition of inhibitors (thermodynamic or kinetic), which prevent hydrate formation and/or deposition.

Pigging is a complex and expensive operation. It is also not well suited for subsea pipelines because the pig has to be inserted using remotely operated subsea vehicles.

Electric heating is possible subsea if the pipeline is not too long, such as of the order of 1-30 km, but it is not currently viable over longer distances—say 50 to 100 km, or longer. However, even over shorter distances, the installation and operational costs are again high. In addition, hydrate formation will occur during production stops or slowdowns, as the hydrocarbons will cool below the hydrate formation temperature.

The addition of a hydrate inhibitor, such as an alcohol (methanol or ethanol) or a glycol such as monoethylene glycol (MEG or 1,2-ethanediol), is inexpensive and the inhibitor is simple to inject. However, if the water content is high, proportionally larger amounts of inhibitor are needed, which at the receiving end, will require a hydrate inhibitor regeneration process unit with sufficient capacity to recover and recycle the inhibitor.

The above techniques may therefore be utilised for short distance transportation (up to approximately 60 km), for example, from the wellhead to a central processing hub. However, they are not suitable for transportation over long distances.

It is also known in the art to carry out some processing of hydrocarbons produced from wells prior to transportation. However, traditional (typically subsea) processing facilities only minimally process the incoming hydrocarbon-containing stream, which is then transported as a two-phase or multi-phase mixture to a central offshore processing hub located between several oil and gas reservoirs/wellheads; see GB 1244273 for example. Further processing of the hydrocarbons to meet pipeline transportation specifications is then performed utilising the processing capacity of the central offshore processing hub.

Whilst such processing allows a multi-phase mixture of hydrocarbon to be transported over relatively short distances back to a processing hub that carries out further processing, it is not extensive enough for long distance transportation.

One known solution is to provide storage local to the wellheads for separated fluids, such as oil and gas, either on the seabed or on a local surface platform, see GB 2544715 and CN 102337868, for example. However, a vessel, (i.e. a tanker ship) is then required to collect the stored fluids and recover them to a master host or platform. This is obviously inefficient and the vessel itself represents a high outlay of capital.

It is also known in the art to fully stabilise the hydrocarbon fluid produced from a well, by separating its constituents and conditioning them for storage prior to transportation away from the well. Full stabilisation is achieved by decreasing the pressure of the produced fluid to atmospheric pressure and separating the gas and liquid phases that result. (A fully stabilised liquid is one that is in a fully stable liquid phase at atmospheric conditions, i.e. it will not evaporate or precipitate into hydrates at atmospheric pressure and ambient atmospheric temperature.) Such a fully stabilised liquid can then be transported to another location, e.g. onshore, at atmospheric conditions and it will remain stable. However, a substantial amount of processing, and hence processing equipment, is required at the reserve in order to achieve this.

According to a first aspect of the present invention, there is provided a system for hydrocarbon production comprising: a host for receiving produced hydrocarbon; an offshore hydrocarbon production facility comprising: a production wellhead for connection to a subsea hydrocarbon reservoir; a production platform configured to receive produced fluid from the wellhead and being in fluid communication with the host via a long distance pipeline; wherein the wellhead is local to the production platform, and the production platform is configured to process the produced fluid to provide a semi-stable oil product suitable for exporting along the long distance pipeline to the host; wherein the host is configured to store the semi-stable oil product or an oil product produced therefrom.

The term "semi-stable" herein is used to describe a liquid that has been stabilised to a certain extent, but has not been fully stabilised. This means that under certain pressure and temperature conditions (in this case the conditions found in a long-distance pipeline) it will remain in a single (liquid) phase, avoiding evaporation and precipitation (i.e. the precipitation of hydrates in the liquid). However, unlike a fully-stabilised liquid, it must be maintained at a pressure above atmospheric pressure. Accordingly, the oil product is taken outside of the "hydrate envelope" for the conditions under which it will be held whilst being transported to the host.

The semi-stable oil product may be stored as such (i.e. maintained in its semi-stable state whilst stored) at the host. Consequently, the oil product may additionally be taken outside of the "hydrate envelope" for the conditions under which it will be held whilst being at the host.

Alternatively, the semi-stable oil product may be further stabilised at the host such that the oil product stored at the host is, or is closer to being, a fully stabilised oil product. Further stabilisation of the semi-stabilised oil product at the host comprises further processing of the semi-stabilised oil product at the host as will become clear from the discussion below. Such further processing equipment may be achieved by further processing equipment including one or more separators, one or more scrubbers, one or more compressors or any other equipment that may be used for further processing of the semi-stable oil product for further stabilisation. The exact nature of the further processing at the host and the equipment used for said further processing will dependent on the nature of the incoming semi-stabilised fluid, the desired level of stabilisation to be achieved at the host, the host itself etc.

An oil product is semi-stabilised by processing, and such processing typically involves the degassing of the oil product and/or the separation of water from the oil product to a certain extent. The extent of this processing is dependent on the conditions at which the oil product will be held whilst being transported and, optionally, whilst being stored, such that it is taken outside of the hydrate envelope, as noted above. Fluid will cool as it passes along a pipeline (due to the cooler water surrounding the pipeline) and may also cool as it is stored. Equally the pressure of fluid will reduce with distance (due to friction) during transportation, and may also reduce whilst stored (e.g. due to imperfect sealing). Therefore, it is necessary to consider conditions along the length of the pipeline and it may also be necessary to consider the conditions under which the semi-stable fluid is stored at the host. A semi-stable oil product typically still comprises some gas fractions from the produced fluid combined with oil fractions and some water from the produced fluid in a single liquid phase, wherein the gas fractions remain entrained in the liquid product under pressurised conditions.

The stability of an oil product is often described by its true vapour pressure (TVP), which (as is known) is the equilibrium partial pressure exerted by the oil product at a temperature of 100° F. (37.8° C.). The true vapour pressure of a fully stabilised product is typically around 0.97 bar, and such an oil product will be stable under atmospheric conditions. Processing of the produced fluid to form a semi-stable oil product may lower the TVP of the oil product to below the TVP of fluid in the reservoir, but above 1 bar, and more typically above 1.3 bar. Producing such a semi-stable liquid product is advantageous since the amount of processing of the produced fluid in the vicinity of the well (e.g. prior to transportation) is reduced compared to a fully stabilised product.

Thus, the invention is partly based upon a recognition by the inventors that there is no need to create a fully stabilised oil product prior to transportation and storage of the oil product away from the well, as long as it is stabilised to the extent that it can be transported via long distance pipelines as a single phase and outside the hydrate forming envelope. Producing a semi-stabilised oil product requires fewer processing steps and less equipment than producing a fully stabilised product. Thus, by means of the invention it is possible to transport the produced fluid over very long distances to a host without the need for either a heated pipeline or a local facility able to fully stabilise the produced fluids, either of which are impracticable and commercially unviable in the case of a marginal reserve.

This means that one host can more readily exploit a very large area of seabed by utilising a number of "satellite" processing facilities that are "tied-back" to the host via long distance pipelines. Each host may exploit a number of local wellheads/reservoirs thereby exploiting a greater are of marginal oil reservoirs and increasing the economic sustainability of such operations further.

The invention also partly resides in the recognition that the semi-stable oil product, after transportation via the long distance pipeline, can be stored at the host, either as such or after further stabilisation of the oil product. The ability to store the oil product product after transportation via a long distance tie-back provides numerous advantages in various hydrocarbon production applications that have not been previously achieved in the prior art. By way of example, in scenarios where the production facility is situated at a marginal (remote) hydrocarbon reserve having a low production volume, the semi-stable oil product formed at the platform can be transported, via the long distance pipeline, to a host in a less remote location (perhaps where there is already some pre-existing infrastructure) and stored there until a significant volume of semi-stable oil product has been received therein. At such a time, it may be feasible (both commercially and technically) to collect the stored semi-stable product with, for instance, a tanker. Without the synergy provided by both the storage at the host and the long distance tie back enabled by the semi-stable nature of the oil product, the recovery of the oil product from the marginal (remote) hydrocarbon reservoir may never otherwise have been (commercially and/or technically) feasible.

The higher pressure at which the semi-stabilised oil product is held during transportation, compared to a fully-stabilised oil product, may also aid in transporting tit along the long distance pipeline without the use of boosters, thereby further reducing the cost and difficulty in setting up the installation.

The produced fluid at the well may typically have a pressure in the range of 100-1000 bar (absolute) and a temperature generally in, but not limited to, the range of 60-130° C. Indeed, the temperature may be as low as 20° C. and as high as 200° C. in HTHP (high-pressure-high-temperature) wells, for example. In addition to hydrocarbons, the produced fluid will often contain liquid water and water in the gas phase corresponding to the water vapour pressure at the current temperature and pressure. As discussed above, if the produced fluid is transported untreated over long distances and allowed to cool, then the water in gas phase will condense and, below the hydrate formation temperature, hydrates will form. The hydrate formation temperature is in the range of 20-30° C. at pressures of between 100-400 bar. Temperature within the long-distance pipeline is typically between 3° C. and 25° C., but may also range between −5° C. and 100° C. Subject to any boosting via pumps that may be provided, the pressure within the pipeline will reduce with distance. However, the pressure must be sufficient to remain above that required at the host. Pressure within the pipeline is typically 10-80 bar, more typically 20-60 bar or 30-40 bar, but may also range up to 300-400 bar. The temperature and pressure are not limited to these conditions, and are dependent on sea temperature, depth, salt content and other metocean data. As noted above, these conditions must be considered when determining the degree of processing to provide the semi-stable oil product for transportation. Based on the temperature and pressure conditions along/within the pipeline, the oil product should remain outside the hydrate formation envelope (i.e. below the hydrate curve) throughout the length of the pipeline as it is transported.

In the event of a shutdown (i.e. the cessation of oil production and processing), the temperate may drop to a level that would bring the oil product into the hydrate formation envelope. However, this may be addressed by depressurising the pipeline.

Although the invention may be carried out using a conventional manned production platform, since only limited processing of the produced fluid is required, an unmanned production platform (UPP™) is both suitable and preferred. The use of an UPP™ greatly improves the commercial viability of producing a marginal reserve.

The system will typically and preferably employ a plurality of such offshore hydrocarbon production facilities (preferably UPP™s), which may be distributed over a very wide area in order to exploit multiple marginal reserves within a given oil field. Each of the plurality of hydrocarbon production facilities would thus be "tied-back" to the host via a long distance pipeline from their respective production platforms, and thus the host may store semi-stable oil originating from a plurality of hydrocarbon production facilities and/or a plurality of marginal reserves. This is particularly advantageous as the storage of the semi-stable oil product produced from a plurality of hydrocarbon production facilities and/or a plurality of marginal reserves can be centralised to a single location. Thus, the infrastructural demands in terms of utilities (e.g. power), provision of chemicals, transportation of the oil product for further use, subsea structural demands etc. may be significantly reduced as compared to, for instance, scenarios where storage is achieved locally at each production facility and/or marginal reserve.

Whilst the system may only be used to provide a transportable oil product, preferably the production platform is further configured to process the produced fluid to produce a gas product and/or a water product. Furthermore, the production platform may be configured to re-inject at least part of the gas product and/or at least part of the water product into the subsea oil reservoir.

Additionally or alternatively, the production platform may be configured to generate electrical power by combusting at least part of the gas product. This reduces or eliminates the need for a separate source of power. In a further alternative (which may be used in combination with the above two alternatives), the gas may be transported for supply as fuel elsewhere. Thus, the gas may be used for injection, for power generation locally, or for supply as a fuel product.

The production wellhead may be entirely subsea, but alternatively it may be partially or wholly located at the surface, as in a dry wellhead/tree. Such dry wellheads may be provided on a jacket structure in shallow waters (less than 150 m water depth). The production wellhead is preferably arranged to supply produced fluid to the production platform via subsea flow lines, a riser base and a riser. Likewise, it is preferably arranged to supply water from the water product and/or gas from the gas product to injection wellheads on the seabed via a riser, riser base and subsea flow lines. Injection wellheads may be configured to inject the water product, gas product, or both, and may inject into the reservoir from which the produced fluid is removed or into a separate, additional well.

Whilst the host may be relatively nearby, e.g. less than 50 km from the wellhead, the invention is particularly useful where the distance is greater, e.g. at least 50 km, at least 100 km or at least 200 km from the offshore hydrocarbon production facility.

In embodiments comprising a plurality of hydrocarbon production facilities the host may be relatively nearby (e.g. less than 50 km) and even local to (i.e. in the proximity of) one of the plurality of hydrocarbon production facilities, whilst the remainder of the plurality of production facilities may be positioned at greater distances, e.g. at least 50 km, at least 100 km or at least 200 km from the host, and are thereby considered to be remote/marginal to the host. Thus the host may rely on the infrastructure (e.g. the provision of utilities, supply of chemicals and materials, etc.) of the relatively nearby hydrocarbon production facility in order to maintain its proper function.

The system may be used with any suitable host, which may, when the geography is appropriate, be on-shore. However, it is believed that in most cases it will be most convenient for the host to be offshore and so the host may bean offshore platform or vessel comprising storage capacity for the semi-stable oil product or an oil product produced therefrom.

Preferably, the host is a subsea storage facility. For instance, the host may comprise one or more subsea storage tanks. The subsea storage tank(s) may for instance be bladder-type storage tank(s) as are known in the art. The subsea storage facility may be configured to maintain the semi-stable oil product as such (i.e. maintain the oil product in its semi-stable state) whilst stored therein. Hence, the semi-stable oil product may be maintained at pressure and temperature conditions in the subsea storage facility that holds the semi-stable oil product outside of the hydrate envelope whilst stored therein. The pressure conditions at the subsea storage may be the same as the pressure conditions within the, or each, of the long distance pipeline(s). The elevated pressure (i.e. pressure above atmospheric pressure) within the subsea storage facility may, at least in part, be maintained by the hydrostatic pressure from the surrounding sea, particularly in embodiments where bladder-type storage tanks are employed. This is particularly advantageous, as it reduces the structural demands of the subsea storage facility.

The host may be configured to further stabilise the received semi-stable oil product prior to storage therein. Thus, the oil product stored at the subsea storage facility may be a semi-stable oil product having a greater stability than the oil product transported thereto via the long distance pipeline, and may in instances be a fully stabilised oil product. The further stabilisation of the oil product at the host may be achieved by means of further processing of the received semi-stable oil product by virtue of further processing equipment located at the subsea storage facility (e.g. separators, scrubbers and the like).

In embodiments wherein the host is a subsea storage facility, the facility preferably comprises at least one conduit (e.g. a riser) by which the stored oil product can be loaded from the subsea storage facility to a vessel (e.g. a tanker).

The vessel may then transport the oil product for further use and/or processing. A pump, or pumps, may be associated with the conduit and they may assist in passaging the stored oil product therethrough and on to the vessel. Alternatively, the elevated pressure at which the stored oil product product may be maintained at may be sufficient in passaging the fluid from the subsea location of the storage and onto the tanker. Loading of the vessel via the conduit may also be aided or achieved via the surrounding hydrostatic pressure, particularly in embodiments that employ bladder-type storage tanks.

Alternatively, the subsea storage facility may be connected to a pipeline that allows for transportation of the stored oil product for further use and/or processing.

The subsea storage facility may comprise its own source of utilities (e.g. a power source) and/or source of supplies (e.g. chemicals) required for the proper functioning and maintenance of the subsea storage facility, or alternatively these may be routed in (e.g. via pipeline, cables etc.) from surrounding, existing infrastructure (e.g. from a nearby production facility). The utilities/supplies required for proper maintenance and functioning of the subsea storage facility vary dependent on a myriad of factors (e.g. its size, its depth, the nature of the oil product to be stored therein etc.); however the skilled person would readily appreciate the utilities and/or supplies required for the proper maintenance of a subsea storage facility on a case by case basis.

As noted above, the invention is particularly advantageous because the oil product need only be partially stabilised such that hydrates cannot form in the long distance pipeline to the host at the temperature and pressure therein (the pipeline typically being unheated). The minimum degree of stabilisation required therefore depends on these conditions (which are well understood and can be determined in a given case by the person skilled in the art). Likewise, at least based on the teaching herein, the skilled person would readily be able to provide such a degree of stabilisation. It will be appreciated that the system remains functional at higher degrees of stability, but this would involve greater-than-necessary processing at the remote platform. Thus, the production platform may typically be configured to process the produced fluid to provide an oil product that is sufficiently stable to be transported to a host located at least 50 km or at least 100 km or at least 200 km distant therefrom via an unheated subsea pipeline without significant hydrate formation.

The oil product that is stored at the host may be later collected by a vessel (e.g. tanker or similar). Alternatively, the oil product may be transported via a pipeline, optionally to an additional processing facility. In this way, a single host can store or transport the oil product from a number of satellite processing facilities local to reservoirs, thereby reducing the storage and transport equipment required.

As previously noted, the processing of the produced fluid will typically involve one or more separation step(s). The skilled person may apply a range of designs of separator, but preferably the production platform comprises a two-stage separation system for producing the semi-stable oil product. In such an arrangement, an oil product outlet may be provided from a second stage of the two-stage separation system, which is connected to the long distance pipeline via a riser and a riser base at the seabed. In addition, there may be a water product outlet from the first stage of the two-stage separation system that is connected to injection wellheads on the seabed.

With regard to the gas product, both stages of the two-stage separation system may have gas outlets leading to a plurality of gas compressors arranged in series, with the final compressor having an outlet for the gas product.

The invention also extends to a corresponding method. Thus, a further aspect of the invention provides a method of hydrocarbon production comprising providing: a host for receiving produced hydrocarbon; and an offshore hydrocarbon production facility, said facility comprising: a production wellhead for connection to a subsea hydrocarbon reservoir; a production platform local to the production platform configured to receive produced fluid from the wellhead and being in fluid communication with the host via a long distance pipeline; wherein the production platform processes the produced fluid to provide a semi-stable oil product and exports it along the long distance pipeline to the host; and wherein the host stores the semi-stable oil product.

Preferably the method comprises providing and using a system according to any of the forms of the system previously described.

Certain embodiments of the present invention will now be described, by way of example only, with reference to the accompanying drawings, in which.

Figure 1:
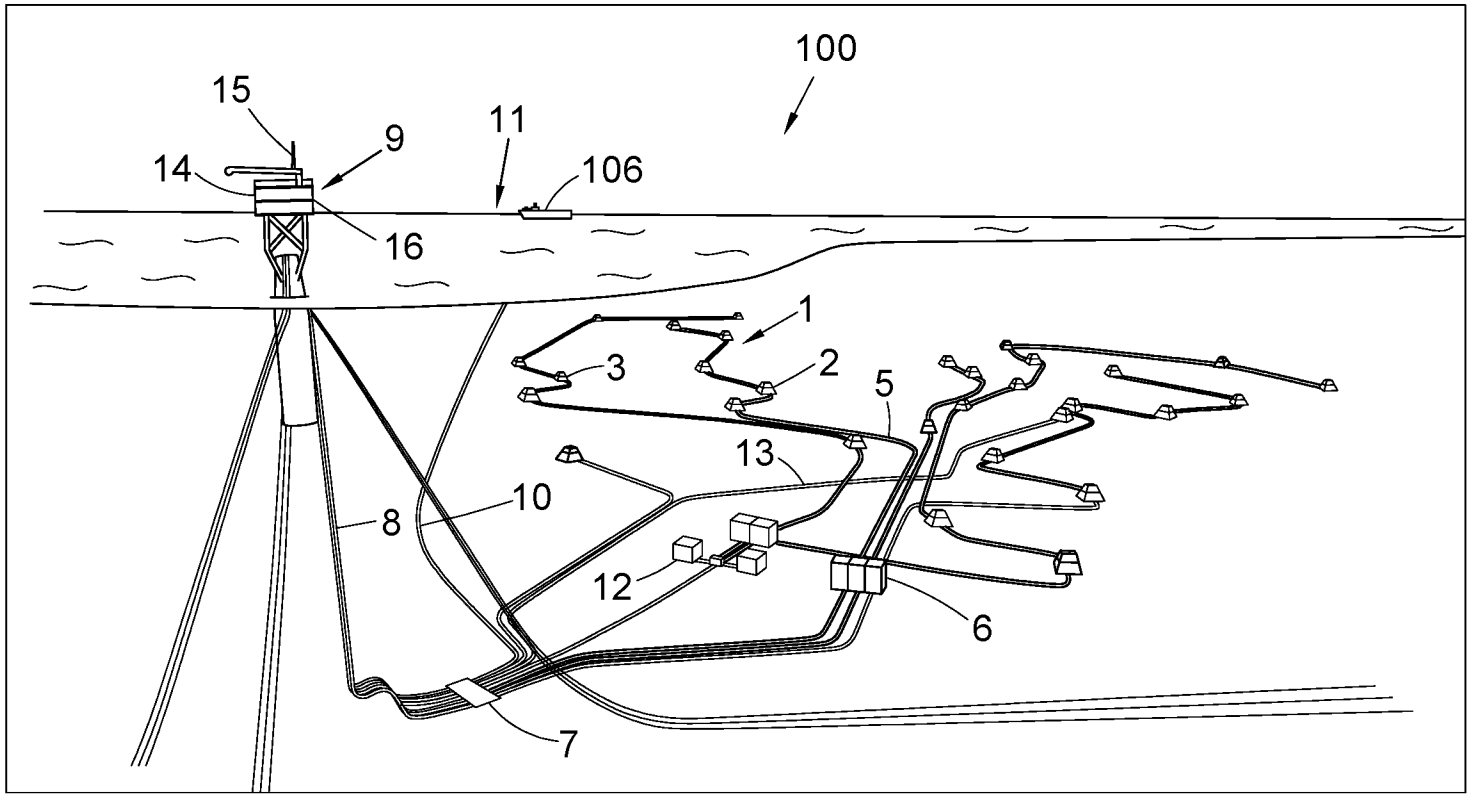
FIG. 1 is a perspective view of a satellite field and host of an embodiment of the present invention.

The illustrated embodiments are subsea hydrocarbon production systems in which a number of satellite fields are connected to a remote host platform, vessel or subsea storage facility over long distances. The remote fields contain what would traditionally have been regarded as marginal reserves. In FIG. 1 only one such satellite field is shown in the foreground and a remote host in the background, but other satellite fields are provide at other remote locations. As will be described below, the satellite field has a local Unmanned Production Platform (UPP™), which separates hydrocarbon-containing fluid produced from local wellheads, partially stabilises an oil product at a and subsequently transports the oil product via a long distance pipeline to a host for further processing, as will be described below.

In FIG. 1, wellheads 1 are shown on the seabed in communication with a subsea hydrocarbon reservoir (not shown). The wellheads comprise producers 2 and injectors 3. The wellheads 1 are connected via flow lines 5, subsea multiphase pumps 6 and a riser base 7 to a riser 8, which provides multiple fluid flow conduits to and from UPP™ 9.

Extending away from the riser base 7 along the seabed is long distance pipeline 10, which extends to a remote host 11, in the form of a tanker vessel 11.

Figure 4:
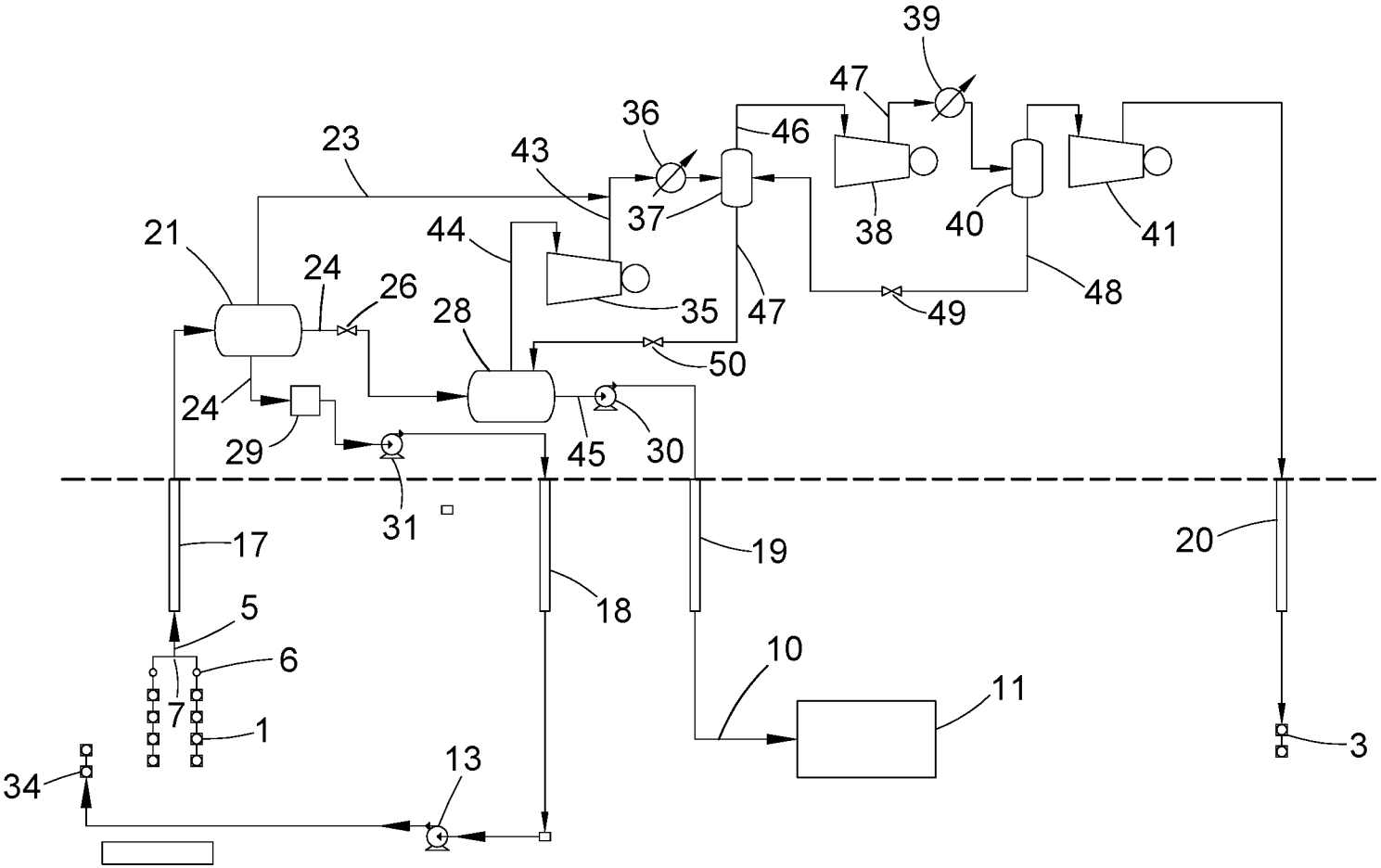
FIG. 4 is a schematic fluid flow diagram showing the separation and processing features of a local Unmanned Production Platform (UPP™), which forms part of the embodiments.

The UPP™ 9 is a floating platform anchored to the seabed. It provides various facilities for treating hydrocarbon-containing fluids (hereinafter also referred to as the produced fluid). These include a separation system 16, which is illustrated in FIG. 4, water treatment system 14, a gas-fuelled power production unit 15 and a gas conditioning system.

The produced fluid is a mixture including oil, water, and natural gas. It is produced from the reservoir in the conventional manner at the producers 2. It then passes through flow lines 5 and is boosted through the subsea multiphase pumps 6 to riser base 7. The hydrocarbon-containing fluid is then lifted through a conduit in riser 8 to UPP™ 9.

At the UPP™ 9, the hydrocarbon-containing fluid is part-processed to produce a semi-stable oil product. The part-processing involves various separation operations involving the separator 16 as will be discussed in more detail below with reference to FIG. 4. The semi-stable oil product is then transported via the riser 8 and the riser base 7 to a long distance pipeline 10 on the seabed.

The oil product is partly stabilized (i.e. rendered semi-stable) by virtue of degassing and dewatering processes, such that it is outside of the hydrate forming envelope of the long-distance pipeline 10, whilst also being within the final processing capability of the host 11. This allows the semi-stable oil product to be transported via long-distance pipelines 10 (up to 250 or even 500 km) to the host 11.

Figure 5:
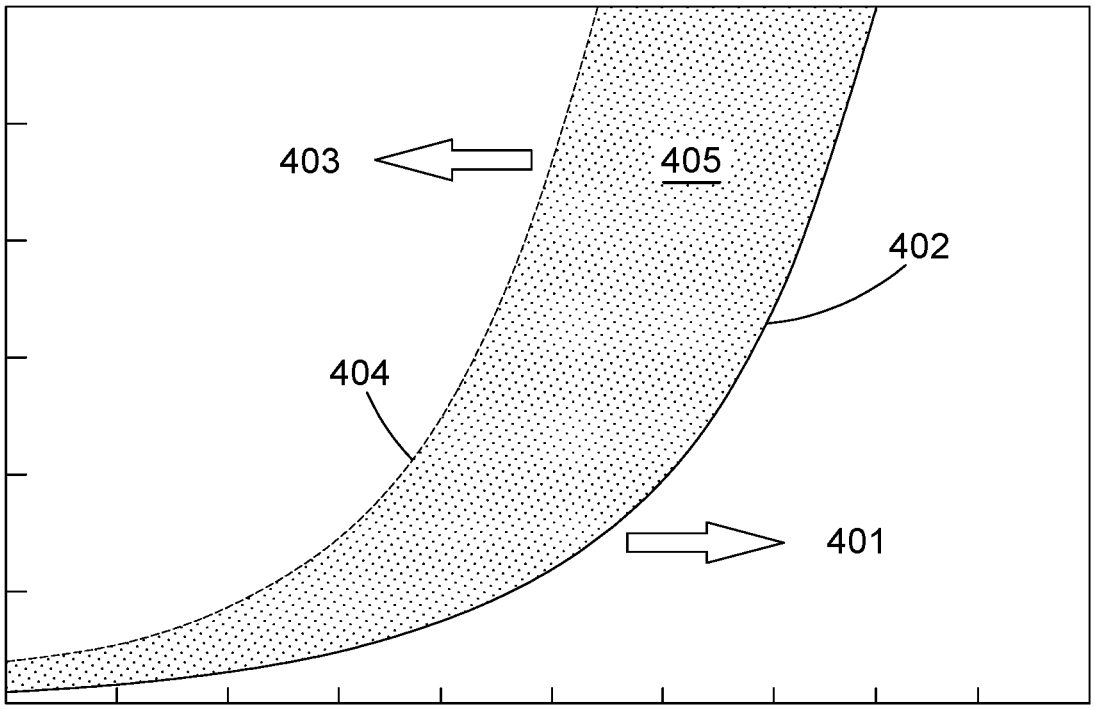
FIG. 5 shows a generic hydrate-formation phase diagram for an oil product.

With reference to FIG. 5, a hydrate formation phase diagram of a typical oil product (which may contain oil, water and gas) can be seen, with the temperature and pressure that the oil product may be held at shown on the X and Y axes respectively. There is a hydrate free region 401 on the right hand side of a hydrate dissociation curve 402, a hydrate stable region 403 (i.e. a region where hydrates have formed and are stable in the fluid) on the left hand side of a hydrate formation curve 404 and a metastable region 405 in between the hydrate formation curve and the hydrate dissociation curve where there is a risk of hydrate formation.

An oil product held at low pressure and high temperature will reduce hydrate formation, whereas high pressures and low temperatures increase hydrate formation.

The degassing and separation of water from the product alters the location of the hydrate formation and dissociation curves. Typically, such processing will move the hydrate formation curve to the left of the figure such that the oil product can be held at higher pressures and lower temperatures without the formation of hydrates.

Typically, the longer the (unheated) long distance pipeline is, the colder the semi-stabilised oil product will become as its temperature approaches that of the seawater surrounding the pipe, thereby increasing the risk of hydrate formation. As a result, a longer pipeline will require an oil product that is processed more (e.g. via degassing and/or water separation) in order to alter the hydrate formation curve and avoid the hydrate formation region.

In these embodiments, the oil product is processed just to the extent that it is taken outside of the hydrate envelope for the conditions of the long distance pipeline so that significant hydrate formation in the pipeline can be avoided (along with avoiding the use of a heated pipeline and/or boosters) in addition to avoiding the use of unnecessary processing equipment at the UPP, thus reducing the cost, size and difficulty in setting up and maintaining these installations.

At the host, the semi-stable oil product is then stored for subsequent transportation to a terminal.

The gas separated from the hydrocarbon-containing fluid is conditioned at the UPP™ 9 so that it may be used for gas injection back into the subsea oil reservoir. After conditioning, the gas passes through a conduit in riser 8, via riser base 7 and flow lines 5 to injectors 3, where it is re-injected into the reservoir. The re-injection of gas is a known process that supports the pressure of the well as fluid is produced and can also cause the pressure to rise in the well, causing more gas molecules to dissolve in the oil, thereby lowering its viscosity and increasing the well's output.

In the illustrated embodiment, some of the gas is used as fuel for power generation at the UPP™ 9. This is carried out by gas turbine power production unit 15 in which the gas (containing short-chain hydrocarbons, i.e. natural gas) is combusted to generate power. Such electrical power production may be used to meet some, or all, of the power demand at the reservoir.

In a variant of this embodiment, instead of using the gas for re-injection, it is also conditioned at the UPP™ 9, (separately from the oil), such that it is also outside of the hydrate-forming region of an additional long-distance pipeline 10' extending to host 11 for storage, along which it is then transported. This further improves the economic sustainability of the reservoir.

The water separated from the hydrocarbon-containing fluid is treated and conditioned at the UPP™ 9 by produced water treatment system 14 to a standard that it can be re-injected into the reservoir to support its pressure. This treated water passes from the UPP™, down through a conduit in riser 8 via riser base 7, flow lines 5 and water injection pumps 13 to water injectors 34.

The separation process is tailored to have specific injection qualities depending on reservoir requirements. The water could be tailored depending on fracking requirements in the reservoir, for pressure support, or treated to an ultrapure quality to meet environmental standards, for example. However, the main requirement is that the treatment allows the produced water to be re-injected into the reservoir via water injection pumps 13.

Some or all water recovered from the hydrocarbon-containing fluid may be treated at the UPP™ 9 to a level that allows it to be released into the sea.

The processing temperature of the liquids (oil/water separation and produced water treatment at the UPP™ 9) is mainly governed by the reservoir temperature, typically ranging from about 20° C. upwards but heat may be added to the liquids for optimal processing temperature.

Figure 2:
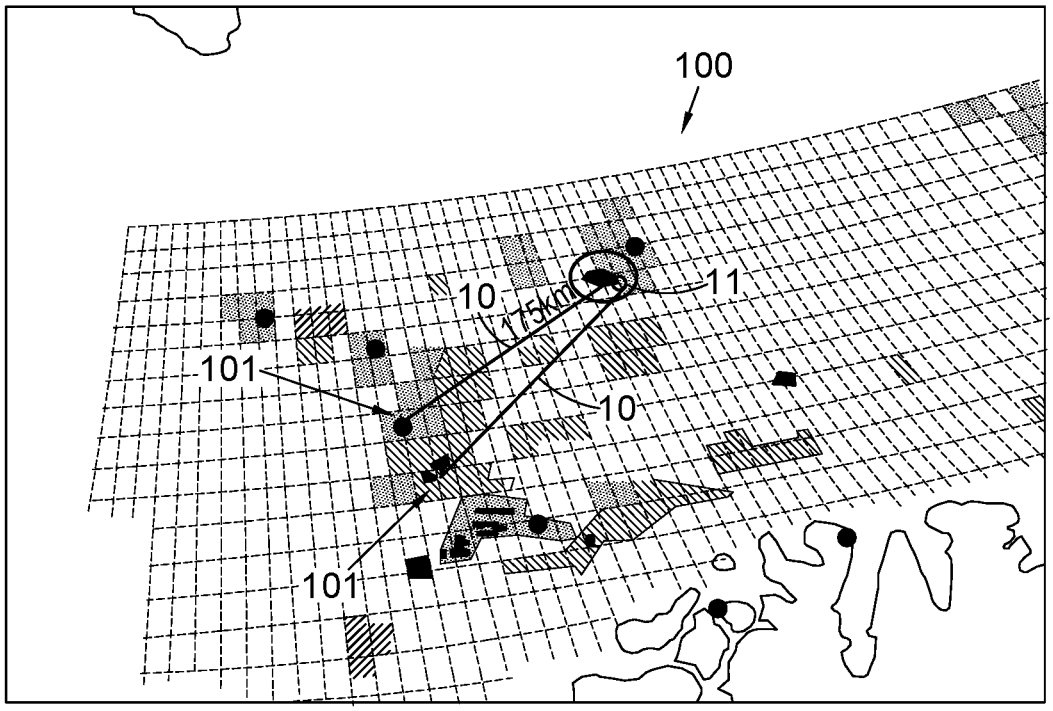
FIG. 2 is an overview of the embodiment of FIG. 1.

The long distances over which the oil product is transported may be seen from FIG. 2, which shows a number of offshore oil production facilities 101 located at marginal fields in the Barents Sea. Each of these offshore oil production facilities 101 corresponds to the local system described above and includes at least one Unmanned Production Platform that is "tied-back" via a long-distance pipeline 10 to a host 11 for storage, thereby allowing the transportation of the oil product to the host. In this embodiment an offshore production facility 101 is tied-back 175 km to a host 11.

Figure 3:
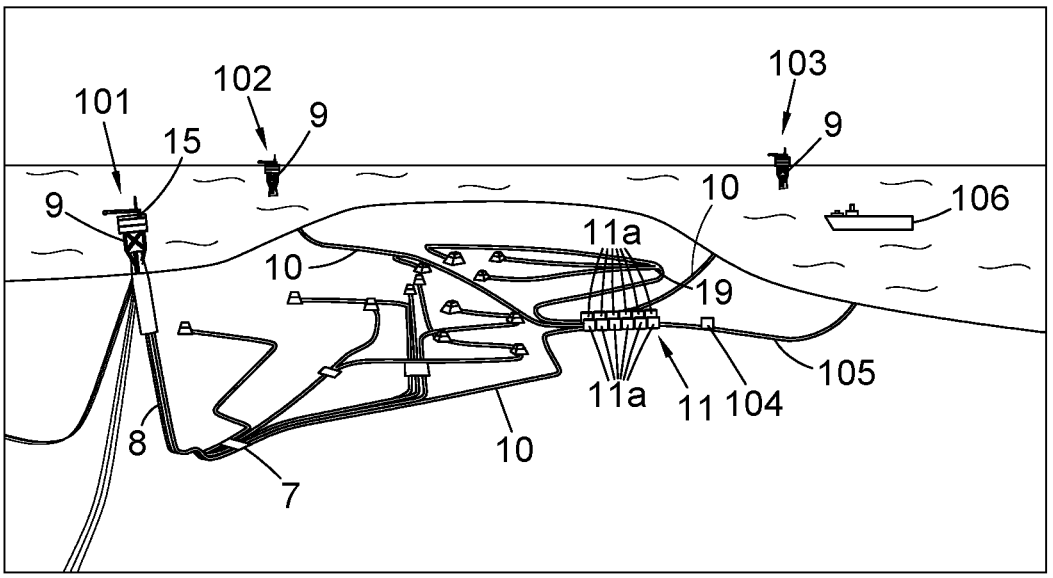
FIG. 3 is a perspective view of a plurality of satellite fields and a host of a further embodiment of the invention.

FIG. 3 shows an alternative embodiment of the invention. Many of the features depicted in the FIG. 3 embodiment correspond to features of the FIGS. 1 and 2 embodiment and therefore a detailed description of these features will not be repeated here.

In FIG. 3, three remote satellite fields are depicted. A first remote field 101, a second remote field 102 and a third remote field 103. Each field 101, 102, 103 comprises its own hydrocarbon production facility positioned local to it. As can be seen in the Figure a UPP™ 9 associated with each hydrocarbon production facility is positioned local to each remote field 101, 102, 103.

The initial hydrocarbon production at each remote satellite field 101, 102, 103 in the embodiment of FIG. 3 occurs in a corresponding manner to the initial production described above in relation to FIG. 1. Similarly, the initial processing of the produced fluid at each UPP™ 9 to form the semi-stable oil product in the embodiment of FIG. 3 occurs in a corresponding manner to the initial processing at the UPP™ 9 of the embodiment of FIG. 1 (which is described in more detail below in relation to FIG. 4). Moreover, as for the UPP™ 9 of the FIG. 1 embodiment, each UPP™ 9 at each remote satellite field 101, 102, 103 is connected to a respective long distance pipeline 10 that fluidly connects each UPP™ 9 to a host 11. It will be noted that in the FIG. 3 embodiment each long distance pipeline 10 connects back into the same, single host 11. Thus the host 11 of the FIG. 3 embodiment can be said to be centralised as it is connected to, and configured to receive semi-stable product from, a plurality of hydrocarbon production facilities Where the embodiment of FIG. 3 significantly differs as compared to the above described embodiment is in relation to the host 11. The host 11 of the FIG. 3 embodiment is a subsea storage facility 11. The subsea storage facility 11 is made up of a plurality of subsea tanks 11*a* that are configured to store the semi-stable oil product incoming from each of the long distance pipelines 10. Each of the subsea storage tanks 11*a* is a pressurised vessel and thus when the semi-stable oil product is received and stored therein, the semi-stable oil product is maintained as such (i.e. the oil product is maintained in its semi-stable state).

A conduit 105 is connected to and in fluid communication the subsea storage facility 11 at a first end of the conduit. A second end of the conduit 105 is positioned at sea level and is configured for connection to a vessel. As shown in the Figure, the second end of the conduit 105 is connected to a tanker 106. The conduit 105 allows the semi-stable oil product within the subsea storage tanks 11*a* to be loaded therefrom and onto a vessel, such as the tanker 106, when the vessel is connected thereto. A pump 104 is positioned along the conduit 105 to assist in propelling the semi-stable oil product through the conduit 105 and onto the vessel (e.g. tanker 106). The loading of the vessel (tanker 106) via the conduit 105 is carried out whilst the semi-stable oil product is maintained as such. Thus, the oil product that arrives at the vessel is a semi-stable oil product.

The embodiment of FIG. 3 allows for the oil product produced at a number of marginal reserves to be brought to a single, centralised location and stored until such a time as a vessel arrives to collect said oil product. Thus, the transportation requirements are significantly reduced as compared to a scenario where a vessel would have to travel to each individual marginal reserve. Moreover, the ability to store the product subsea at the host means that continuous off load of the produced oil product from each of the marginal reserves is not required. This is particularly beneficial where the production rate of the marginal reserves is low or where the marginal reserves are located in a remote, hard to reach location such that continuous offload (e.g. via pipeline) of the oil product is not commercially and/or technically viable.

The flow diagram of FIG. 4 schematically shows the separation and processing features of the local UPPs™ 9 of the above described embodiments in greater detail, along with the subsea components of the embodiments, which have been described already with reference to FIGS. 1 and 3. Thus, produced fluid from a number of wellheads 1 is boosted through multi-phase pump 6 and then passes through flow lines 5, and riser base 7 and production riser conduit 17 to the UPP™ (which houses the components shown above the central horizontal dividing line). Also shown are certain water injection components, including water injection pumps 13, which are fed with produced water by water injection riser conduit, and water injectors 34. In addition, gas injectors 3 are shown connected to gas injection riser conduit 20.

It should be noted that the production riser conduit 17, produced water riser conduit 18, semi-stable crude oil riser conduit 19 and gas injection riser conduit 20 are all included in the structure of riser 8 (see FIG. 1). They are shown separated in FIG. 3 merely for clarity.

The production riser conduit 17 leads to a first stage, three phase, separator 21 having outlet conduits 23 for gas, 24 for oil and 36 for water. The first is connected to the output from a downstream flash gas compressor, which will be discussed below. The second leads via valve 26 to the input of second stage separator 28. The separators may be gravity separators, cyclone separators or any other separator known in the art. The third outlet conduit leads, via water treatment unit 29 and produced water pump 31, to produced water riser 18.

The second stage separator 28 is two-phase, having outlet conduits 44 for gas and 45 for oil product. The former is connected to flash gas compressor 35 which has an outlet conduit 43 which connects to gas outlet conduit 23 from the first stage separator and leads to first interstage gas cooler 36 and then to fist stage suction scrubber 37. The latter 45 leads via oil product pump 30 and semi-stable crude oil riser 19 to the long distance pipeline 10 leading to host 11 (see FIG. 1).

First stage suction scrubber 37 has a single outlet conduit 46 leading to first stage gas injection compressor 38. The outlet conduit 47 from this leads via a second interstage gas cooler 39 to a second stage suction scrubber 40 and a second stage gas injection compressor 41 which feeds gas inlet riser conduit 20, which leads to the gas injectors 3 at the sea bed.

The suction scrubbers both also have outlet conduits 47, 48 for oil that has been scrubbed from the gas. The one from the second stage suction scrubber 48 leads back via valve 49 to the first stage scrubber and the one from the first stage scrubber 47 leads back via valve 50 to second stage separator 28.

After the produced fluid has been lifted through the production riser 17 to the UPP™ 9, it enters first stage separator 21. This holds the hydrocarbon-containing fluid at a pressure of approximately 15 bar and partially separates the fluid into three components: primarily consisting of oil, gas, and water respectively in the known manner.

The separated component primarily consisting of oil is then passed via conduit 24 and valve 26 to second stage separator 28. The separated water is passed through water conduit 25 to water treatment unit 29 and the separated gas is passed through gas conduit 23.

The second stage separator 28 reduces the oil fluid component to a pressure of approximately 4 bar, a lower pressure than the first stage separator in order to flash down the oil fluid component, thereby releasing gas from within the fluid. This flash gas is separated from the oil fluid component such that the oil product is conditioned (dewatered and degassed) to a level at which it is semi-stabilised. The level of dewatering and degassing required depends on the conditions that the oil will be held at, particularly when transported via the long-distance oil pipeline 10, and the corresponding hydrate forming envelope for the oil product under these conditions.

Thus, the semi-stabilised oil product passes from the second stage separator 28 in a condition that is outside of the hydrate-forming envelope of the long-distance pipeline 10 to the host 11. Following this, the semi-stabilised oil product is boosted through oil product pump 30, and passed down semi-stable oil product riser 19, after which it is exported to the host along subsea long-distance export lines 10. As the semi-stabilised oil product is outside of the hydrate-forming region, the use of heating, insulation, introduction of hydrate inhibitors and/or pigging is not necessary in the long-distance pipeline 10.

In this embodiment, the flash gas produced in second stage separator 28 (at a pressure of 4 bar) is removed from the second stage separator 28 and recompressed to a pressure of 15 bar (the same pressure as the gas removed from the first stage separator 21) in flash gas compressor 35. The flash gas is then recombined with the gas removed via the first stage separator 21 and passed through a first interstage gas cooler 36 in order to cool the gas and remove the resultant heat from the prior compression. In this embodiment, the cooling in each cooler is carried out via a heat exchanging relationship with seawater and/or air.

The combined gas ("the gas") is then passed through first stage suction scrubber 37 in order to remove particulates and condensates from the gas and protect later gas compressors. This improves the performance of later stage gas compressors and other components.

The gas is then passed through first stage gas injection compressor 38 in order to raise its pressure to 38 bar. The gas is subsequently cooled in second interstage gas cooler 39.

The gas then enters second stage suction scrubber 40 in order to remove any further particulates or condensate before entering a second stage gas injection compressor 41 that raises the pressure of the gas to 100 bar, the final pressure before re-injection into the subsea reservoir.

The gas at 100 bar is then passed down through gas injection riser 20 to gas injectors 3, where it is re-injected into the reservoir to support the reservoir pressure.

The separated water from first stage separator 21 is conditioned at water treatment unit 29 in order to meet the conditions required for re-injection into the subsea oil reserve, as discussed above. This produced water is then pumped through produced water pump 31, and passed down produced water riser conduit 18.

The invention claimed is:

1. A system for hydrocarbon production comprising:

a host for receiving produced hydrocarbon;

an offshore hydrocarbon production facility comprising:

a production wellhead for connection to a subsea hydrocarbon reservoir; and a production platform configured to receive produced fluid from the wellhead and being in fluid communication with the host via a long distance pipeline;

wherein the wellhead is local to the production platform, and the production platform is configured to process the produced fluid to provide a semi-stable oil product suitable for exporting along the long distance pipeline to the host, wherein the host is configured to store the semi-stable oil product or an oil product produced therefrom, wherein the production platform comprises a two-stage separation system for producing the semi-stable oil product, and wherein a water product outlet from a first stage of the two stage separation system is connected to injection wellheads on the seabed.

2. The system according to claim 1, wherein the processing of the produced fluid comprises degassing the produced fluid and/or separating water from the produced fluid to an extent that the semi-stabilised fluid is taken outside of the hydrate envelope for the conditions within the long distance pipeline, whereby significant formation of hydrates in the long distance pipeline is avoided.

3. The system according to claim 1, wherein the semi-stable oil product has a true vapour pressure (TVP) of greater than 1 bar and less than the true vapour pressure of the produced fluid from the well.

4. The system according to claim 3, wherein the semi-stable oil product has a true vapour pressure greater than 1.3 bar and less than 400 bar, preferably a true vapour pressure of greater than 20 bar and less than 60 bar, and more preferably a true vapour pressure of greater than 30 bar and less than 40 bar.

5. The system according to claim 1, wherein the host is located at least 50 km or at least 100 km or at least 200 km from the offshore hydrocarbon production facility.

6. The system as claimed in claim 1, wherein the host is a subsea storage facility.

7. The system as claimed in claim 6, wherein the subsea storage facility comprises one or more subsea storage tanks.

8. The system as claimed in claim 1, wherein the host is configured to maintain the semi-stable oil product as such whilst stored therein.

9. The system as claimed in claim 8, wherein the host maintains the temperature and pressure conditions of the semi-stable oil product outside of the hydrate formation envelope whilst stored therein.

10. The system as claimed in claim 1, wherein the host is configured to further process the semi-stable oil product in order to further stabilise the semi-stable oil product prior to storage therein.

11. The system as claimed in claim 10, wherein the host is configured to fully stabilise the semi-stable oil product prior to storage therein.

12. The system as claimed in claim 1 comprising a conduit connected to the host, the conduit being configured for loading oil product stored at the host to a vessel.

13. The system according to claim 1, wherein the offshore hydrocarbon production facility is an unmanned production platform (UPP).

14. The system according to claim 1 comprising a plurality of such offshore hydrocarbon production facilities, wherein the platform of each hydrocarbon production facility is connected to the host via a respective long distance pipeline such that the host is configured to store oil product from each of the plurality of hydrocarbon production facilities.

15. The system as claimed in claim 14, wherein each hydrocarbon production facility is located at a different marginal hydrocarbon reserve.

16. The system as claimed in claim 14, including a further hydrocarbon production facility comprising:

a production wellhead for connection to a subsea hydrocarbon reservoir; and a production platform configured to receive produced fluid from the wellhead and being in fluid communication with the host, wherein the wellhead is local to the production platform, wherein the production platform is configured to process the produced fluid suitable for exporting to the host, and wherein the host is positioned local to the further hydrocarbon production facility.

17. The system according to claim 1, wherein the production platform is configured to process the produced fluid to provide an oil product that is sufficiently stable to be transported to the host located at least 50 km or at least 100 km or at least 200 km distant therefrom via an unheated subsea pipeline, without the use of hydrate inhibitors, whereby formation of significant hydrates in the long distance pipeline is avoided.

18. The system according to claim 1, wherein an oil product outlet from a second stage of the two-stage separation system is connected to the long distance pipeline via a riser and a riser base at the seabed.

19. The system according to claim 1, wherein both stages of the two-stage separation system have gas outlets leading to a plurality of gas compressors arranged in series and wherein the final compressor has an outlet for the gas product.

20. A method of hydrocarbon production comprising providing: a host for receiving produced hydrocarbon; and an offshore hydrocarbon production facility, said facility comprising:

a production wellhead for connection to a subsea hydrocarbon reservoir; and a production platform local to the production wellhead, configured to receive produced fluid from the wellhead and being in fluid communication with the host via a long distance pipeline;

wherein the production platform processes the produced fluid to provide a semi-stable oil product and exports it along the long distance pipeline to the host, wherein the host stores the semi-stable oil product, wherein the production platform comprises a two-stage separation system for producing the semi-stable oil product, and wherein a water product outlet from a first stage of the two stage separation system is connected to injection wellheads on the seabed.

21. The method as claimed in claim 20, comprising providing and using a system according to claim 1.

* * * * *